US006297601B1

(12) United States Patent
Kang

(10) Patent No.: US 6,297,601 B1
(45) Date of Patent: Oct. 2, 2001

(54) APPARATUS AND METHOD FOR SAVING ELECTRIC POWER IN A DISPLAY SYSTEM

(75) Inventor: Ho-Woong Kang, Yongin (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/634,651

(22) Filed: Aug. 8, 2000

(30) Foreign Application Priority Data

Aug. 31, 1999 (KR) ..... 99-36714

(51) Int. Cl.[7] ..... G09G 1/04

(52) U.S. Cl. ..... 315/387; 315/411; 361/18; 363/21

(58) Field of Search ..... 315/387, 408, 315/411; 363/20, 21, 50, 56; 361/18

(56) References Cited

U.S. PATENT DOCUMENTS 5,751,925 * 5/1998 Kataoka et al. ..... 395/115
5,917,716 * 6/1999 Cho ..... 363/21
5,961,647 * 10/1999 Kim et al. ..... 713/300
5,994,852 * 11/1999 Lee ..... 315/408
6,005,789 * 12/1999 Lee ..... 315/387
6,034,729 * 3/2000 Lim ..... 315/411

* cited by examiner

*Primary Examiner*—Don Wong
*Assistant Examiner*—Thuy Vinh Tran
(74) *Attorney, Agent, or Firm*—Robert E. Bushnell, Esq.

(57) ABSTRACT

The present invention relates to an apparatus and a method for saving electric power in a display system in which, when the display system is turned to an off mode, a total electric power consumption is reduced to a range for the display system to be operated through a reduction of an on-duty time period of a PWM pulse by using a charging/discharging device of a large capacitance. The present invention provides an ultra electric power-saving mode for a display system when the display system is turned into an off mode with no input of the horizontal and vertical synchronization signals from a video card of the computer main body to the display system. It accomplishes this by reducing the total electric power consumption by approximately half compared to the existing off mode performance through a remarkable reduction of the on-duty time of a PWM pulse to a range of supplying an operational voltage of the microcomputer with the use of a charging/discharging device of large capacitance.

30 Claims, 11 Drawing Sheets

APPARATUS AND METHOD FOR SAVING ELECTRIC POWER IN A DISPLAY SYSTEM

CLAIM OF PRIORITY

This application makes reference to, incorporates the same herein, and claims all benefits accruing under 35 U.S.C. §119 from my application POWER SAVING APPARATUS AND METHOD FOR DISPLAY SYSTEM filed with the Korean Industrial Property Office on Aug. 31, 1999 and there duly assigned Ser. No. 36714/1999.

BACKGROUND OF THE INVENTION

1. Technical Field

The present invention relates to an electric power supply apparatus for a display system and, more particularly, to an apparatus and a method for saving electric power in a display system in which, when the display system is turned to an off mode, total electric power consumption is reduced to a range wherein the display system can be operated through a reduction of an on-duty time period of a pulse width modulation (PWM) pulse by using a charging/discharging device of large capacitance.

2. Related Art

Most display systems appearing on the market recently are equipped with an electric power-saving mode. The power-saving mode proceeds sequentially through a normal mode, a suspend mode, a standby mode, and an off mode, depending on whether or not horizontal and vertical synchronization signals from a video card built into the main body of a computer are inputted.

The off mode is applied when neither the horizontal nor vertical synchronization signals are inputted from the video card in the main body of the computer.

Specifically, the off mode is used to minimize electric power consumption in a display system by cutting off electric power supplied to all parts of the computer when a user does not use the display system, that is, when it is determined, as a result of a detection process, that neither horizontal nor vertical synchronization signals are inputted.

In the off mode, a microcomputer is still supplied with sufficient electric power to enable the display system to be turned to the normal mode when horizontal and vertical synchronization signals are inputted from the video card in the main body of the computer.

In such a system as generally described above, the power savings achieved are limited, even when the system is placed in the off mode. This is due to the fact that, even when in the off mode, the system must provide power to the microcomputer so that it can continue to monitor the status of a signal input from the computer main body in order to determine whether horizontal and vertical synchronization signals are being inputted from a video cord in the computer main body. Since, in such a system as described above, power must be provided to the microcomputer at all times, satisfactory power savings cannot be achieved.

SUMMARY OF THE INVENTION

In order to solve the above problem, it is an object of the present invention to provide an apparatus and a method for saving electric power in a display system in which, when the display system is turned to an off mode, total electric power consumption is reduced to a range wherein the display system can be operated through a reduction of an on-duty time period of a PWM pulse by using a charging/discharging device of a large capacitance.

In order to achieve the above object, according to the present invention, an electric power-saving apparatus for a display system provides an electric power-saving mode as an off mode through a reduction of electric power consumed in an entire system when horizontal and vertical synchronization signals are not inputted from a computer main body during a predetermined time period. The apparatus comprises: an electric power supply control part for selectively generating a PWM pulse of a PWM circuit section in response to an electric power supply control signal inputted from an external source; an operational voltage supply part for generating an operational voltage, wherein the operational voltage supply part is charged with energy induced in a secondary winding of a switching transformer when the PWM pulse is generated by the PWM circuit section under the control of the electric power supply control part, and commercial electric power is supplied to a primary winding of the switching transformer and the operational voltage supply part is discharged when the PWM pulse is not generated under the control of the electric power supply control part; and a microcomputer which is driven based on the operational voltage inputted from the operational voltage supply part for switching the entire system into the off mode when the horizontal and vertical synchronization signals are not inputted from the computer main body,and for outputting the electric supply control signal in order for the PWM pulse to be generated as soon as a remaining voltage becomes lower than a minimum value of an input compensation voltage of the operational voltage supply part when the operational voltage supply part is discharged.

Further, in order to achieve the above object, according to the present invention, an electric power-saving apparatus for a display system provides an electric power-saving mode as an off mode through a reduction of electric power consumed in an entire system when horizontal and vertical synchronization signals are not inputted from a computer main body during a predetermined time period. The apparatus comprises: an electric power supply control part for selectively supplying commercial electric power provided to a primary winding of a switching transformer in response to an electric power supply control signal inputted from an external source; an operational voltage supply part which is charged with energy induced in a secondary winding of the switching transformer in response to a PWM pulse when the commercial electric power is supplied to the primary winding of the switching transformer under control of the electric power supply control part, and which is discharged when the commercial electric power is not supplied to the primary winding of the switching transformer under control of the electric power supply control part; and a microcomputer which is driven based on the operational voltage inputted from the operational voltage supply part for switching the entire system into the off mode when the horizontal and vertical synchronization signals are not inputted from the computer main body, and for outputting the electric supply control signal in order for the commercial electric power to be supplied to the primary winding of the switching transformer as soon as a remaining voltage becomes lower than a minimum value of an input compensation voltage of the operational voltage supply part when the operational voltage supply part is discharged.

Furthermore, in order to achieve the above object, according to the present invention, an electric power-saving method for a display system comprises the steps of: (1) determining whether horizontal and vertical synchronization signals are inputted from a computer main body; (2) performing a normal mode of operation when the horizontal and vertical synchronization signals are inputted from the computer main body, switching the entire system into an off mode when the horizontal and vertical synchronization signals are not inputted by outputting a turn-off signal to cut off a voltage supplied to each load, and outputting an electric power supply control signal to selectively control an induction of energy in a secondary winding of the switching transformer; (3) outputting the electric power supply control signal and then counting a time period; (4) determining if the counted time period is the same as a predetermined time period; (5) determining whether the horizontal and vertical synchronization signals are inputted from the computer main body when the counted time period is the same as the predetermined time period; (6) setting the electric power supply control signal to a turn-off state before switching the entire system from the off mode to a normal mode when the horizontal and vertical synchronization signals are inputted from the computer main body, and outputting a turn-on signal for supplying the voltage to each load; and (7) outputting the electric power supply control signal for energy not to be induced in the secondary winding of the switching transformer when the horizontal and vertical synchronization signals are not inputted from the computer main body.

BRIEF DESCRIPTION OF THE DRAWINGS

A more complete appreciation of the invention, and many of the attendant advantages, thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Hereinafter, embodiments of the present invention will be described in detail with reference to the accompanying drawings.

Figure 1:
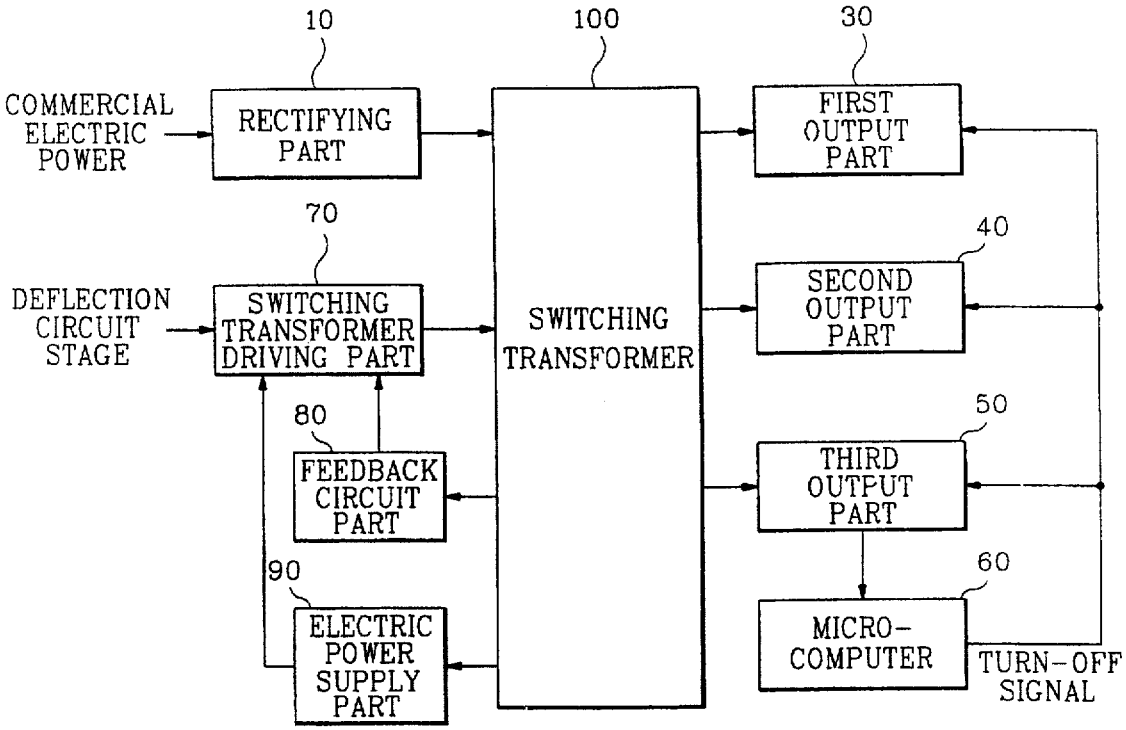
FIG. 1 is a block diagram of an apparatus illustrating electric power-saving modes in a display system.
Figure 2:
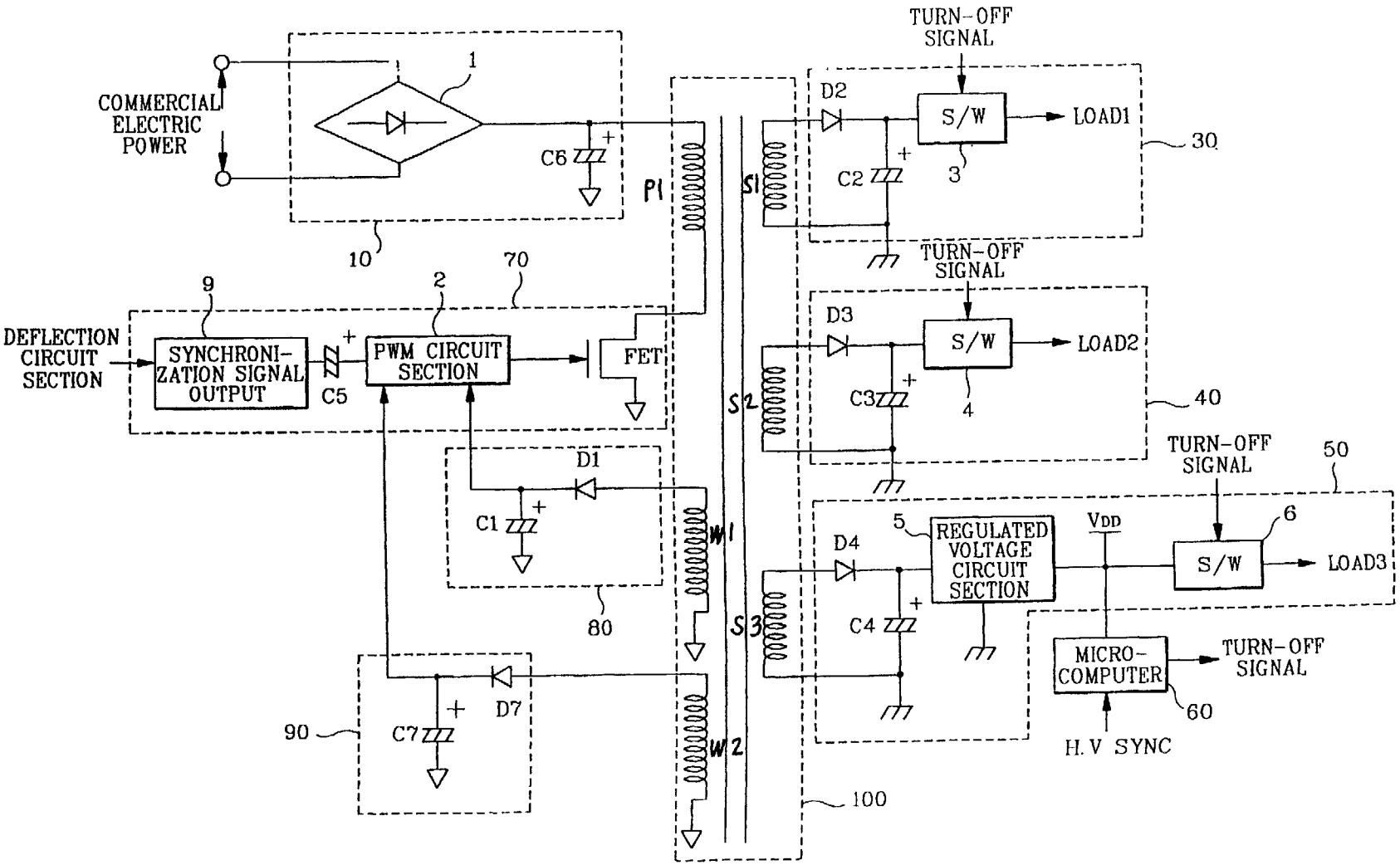
FIG. 2 is a detailed circuit diagram of the apparatus of FIG. 1.

FIG. 1 is a block diagram of an apparatus for carrying out electric power-saving modes in a display apparatus, and FIG. 2 is a circuit diagram of the apparatus of FIG. 1.

In FIG. 1 and FIG. 2, reference numeral 10 denotes a rectifying part having a bridge diode 1 and a capacitor C6.

Reference numeral 30 denotes a first output part having a first output section (diode D2, capacitor C2) and a switch 3. Reference numeral 40 denotes a second output part having a second output section (diode D3, capacitor C3) and a switch 4, and reference numeral 50 denotes a third output part having a third output section (diode D4, capacitor C4), a regulated power supply circuit section 5, and a switch 6.

Reference numeral 60 denotes a microcomputer, while reference numeral 70 denotes a switching transformer driving part having a switching device (field effect transistor FET, a PWM circuit section 2, a capacitor C5, and a synchronization signal output section 9). Reference numeral 90 denotes an electric power supply part having a diode D7 and a capacitor C7.

Operation of the circuit having the above-stated parts will be described in detail with reference to FIG. 2.

As shown in FIG. 2, the bridge diode 1 rectifies a commercial electric voltage inputted from an external source and supplies the rectified output to the primary winding P1 of a transformer 100 through the capacitor C6. At this point, the switching device FET is switched in response to a PWM pulse inputted from the PWM circuit section 2.

The switching transformer 100 is supplied, through the primary winding P1, with an electric current inputted from the bridge diode 1 dependent on the switching device FET being switched, and energy is induced into the secondary windings S1, S2 and S3 due to the electric current flowing in the primary winding P1. Different energies are induced into the secondary windings dependent on the number of turns of each secondary winding.

The plural output sections (D2, C2), (D3, C3), (D4, C4) are connected to the secondary windings S1, S2 and S3, respectively, of the switching transformer 100, and convert energies induced in the secondary windings into direct voltages to be outputted to loads.

The plural switches 3, 4, and 6 interconnect the respective output sections (D2, C2), (D3, C3), and (D4, C4) with the respective loads LOAD1, LOAD2, and LOAD3, so as to supply output voltages of the respective output sections (D2, C2), (D3, C3), and (D4, C4) to the respective loads LOAD1, LOAD2, and LOAD3 in response to a turn-on signal from the microcomputer 60, and the plural switches 3, 4, and 6 cut off the voltages outputted to the respective loads LOAD1, LOAD2, and LOAD3 in response to a turn-off signal from the microcomputer 60.

The feedback circuit part 80 is connected to a first auxiliary winding W1 of the switching transformer 100, monitors the first, second and third output sections (D2, C2), (D3, C3) and (D4, C4), respectively, and outputs a feedback signal to the switching transformer driving part 70 to adjust the duty ratio of a PWM pulse according to the result of monitoring.

An electric power supply part 90 is connected to a second auxiliary winding W2 of the switching transformer 100 so as to output driving electric power for the PWM circuit section 2.

The regulated voltage circuit section 5 receives a direct voltage input from the third output section (D4, C4) and converts the inputted voltages to an operation voltage for the microcomputer 60.

The microcomputer 60 is driven by the voltage from the regulated voltage circuit section 5, and outputs a turn-off signal for cutting off electric power supplied to each load LOAD1, LOAD 2 and LOAD 3 when the horizontal and vertical synchronization signals inputted from the video card in the computer main body do not exist.

The synchronization signal output section 9 outputs a synchronization signal in response to a feedback signal from a deflection circuit section.

The PWM circuit section 2 is driven by electric power supplied from the electric power supply part 90 so as to output a PWM pulse having a duty ratio determined by a control signal from the microcomputer 60 and a feedback signal through the feedback circuit part 80. In this way, PWM circuit section 2 controls the tun-on and turn-off time period of the switching device FET.

In the operation of a power-saving apparatus of a display system having the structure as stated above, microcomputer 60 determines whether the horizontal and vertical synchronization signals inputted from a video card in a computer main body exist.

When the horizontal and vertical synchronization signals do not exist, the entire system is converted to an off mode. That is, the microcomputer 60 outputs a turn-off signal to the switches 3, 4 and 6 provided in the first, second, and third parts 30, 40, and 50, respectively, so as to convert the entire system into the off mode. Thus, direct voltages of the first, second and third output parts 30, 40 and 50, respectively, are not supplied to the loads LOAD1, LOAD2, and LOAD3, respectively.

At this point, the microcomputer 60 is supplied with an operation voltage even though the system is in the off mode since the microcomputer 60 continues to monitor signals inputted from the computer main body.

The PWM circuit section 2 is driven with a voltage Vcc supplied from the electronic power supply part 90, and generates a PWM pulse based on a synchronization signal outputted from the synchronization signal output section 9, as inputted through the coupling capacitor C5.

The PWM circuit section 2 outputs a PWM pulse to the switching device FET, the switching device FET is turned on in response to the input of the PWM pulse, an electric current is supplied to the primary winding P1 of the transformer 100, and energy is then induced into the secondary windings S1, S2 and S3 so as to be supplied to the output parts 30, 40 and 50, respectively.

At this point, a direct voltage is supplied to the third output section(D4, C4), and the direct voltage is converted into an operational voltage for the microcomputer 60 through the regulated voltage circuit section 5.

Accordingly, when the entire system is switched into an off mode, the output part 50 of the plural output parts 30, 40 and 50 must still be operated since it is connected to the microcomputer 60 and must provide electric power to the microcomputer 60, even in the off mode.

Thus, in the above apparatus, there exists a problem in that there is a limitation to the minimization of electric power consumption which can be achieved since voltage must be supplied to the microcomputer at all times.

FIG. 3 through FIG. 6 are block diagrams and circuit diagrams for describing a first embodiment of the electric power-saving apparatus for a display system according to the present invention, wherein only parts and portions different from these of the apparatus of FIGS. 1 and 2 are described, and descriptions of common parts and portions are omitted.

Figure 3:
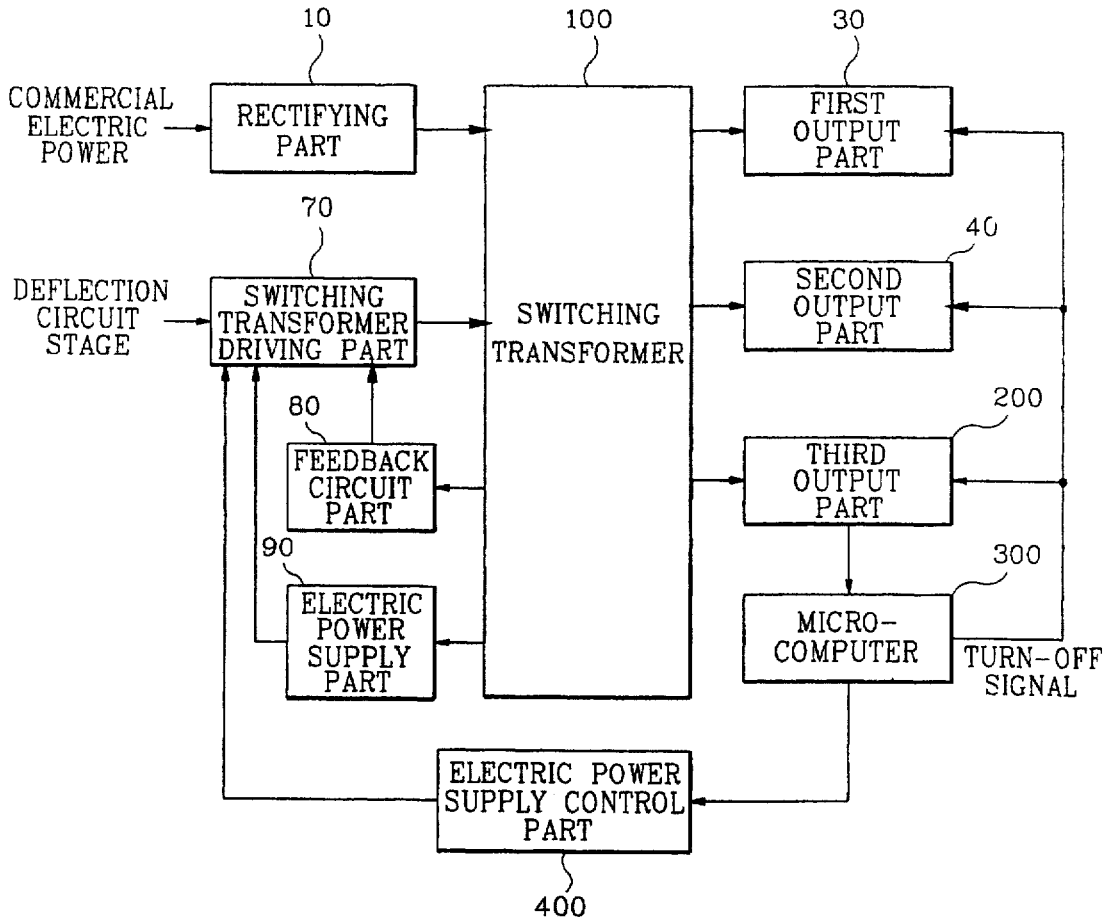
FIG. 3 is a block diagram of an electric-power saving apparatus for a display system according to a first embodiment of the present invention.
Figure 4:
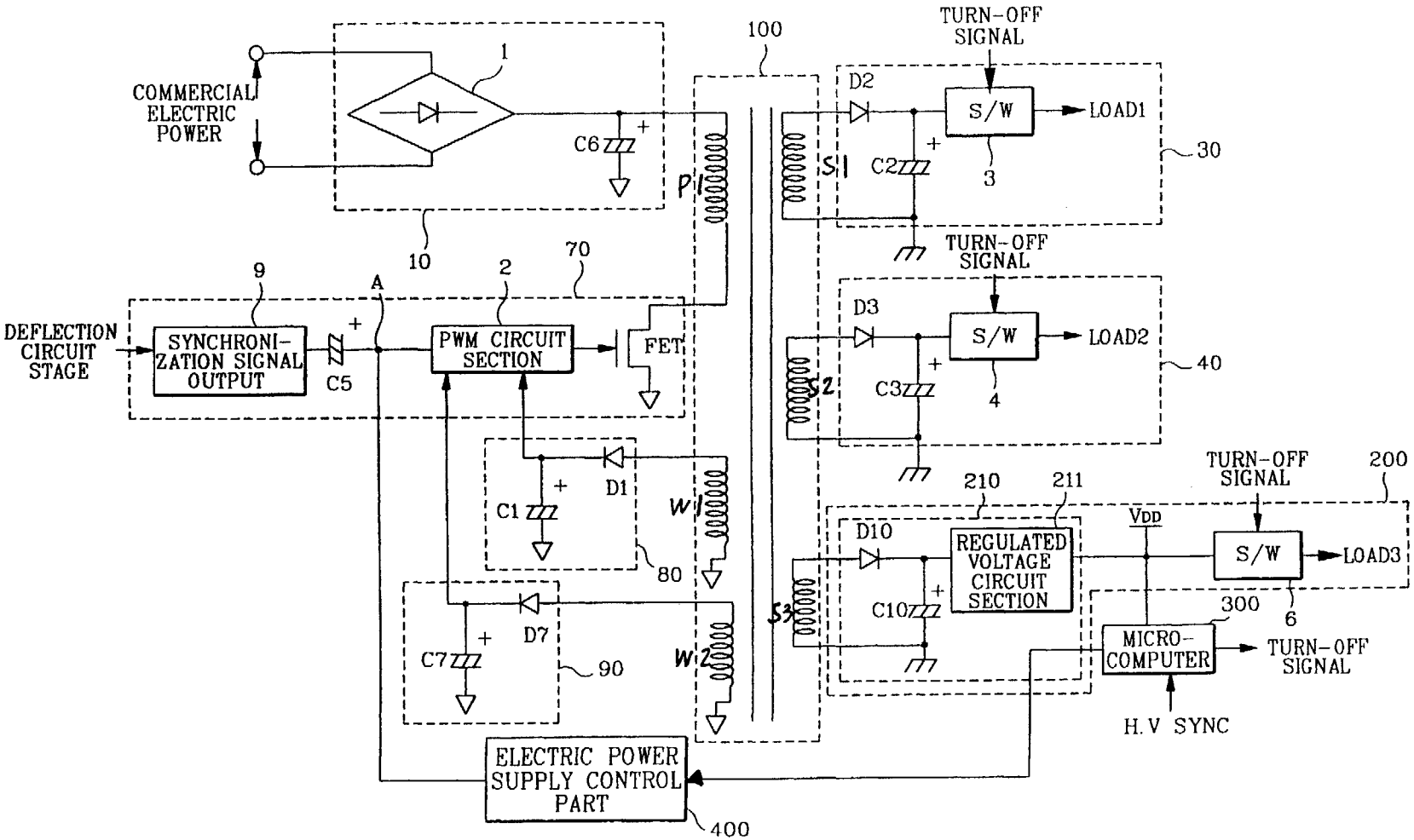
FIG. 4 is a detailed circuit diagram of the a first embodiment of the apparatus of FIG. 3.

As shown in FIG. 3 and FIG. 4, reference numeral 200 denotes a third output part and a capacitor C10, provided in an operational voltage supply part 210, has a large capacitance relative to the capacitance of capacitor C4 of FIG. 2.

Reference numeral 300 denotes a microcomputer and reference numeral 400 denotes an electric power supply control part.

Figure 5:
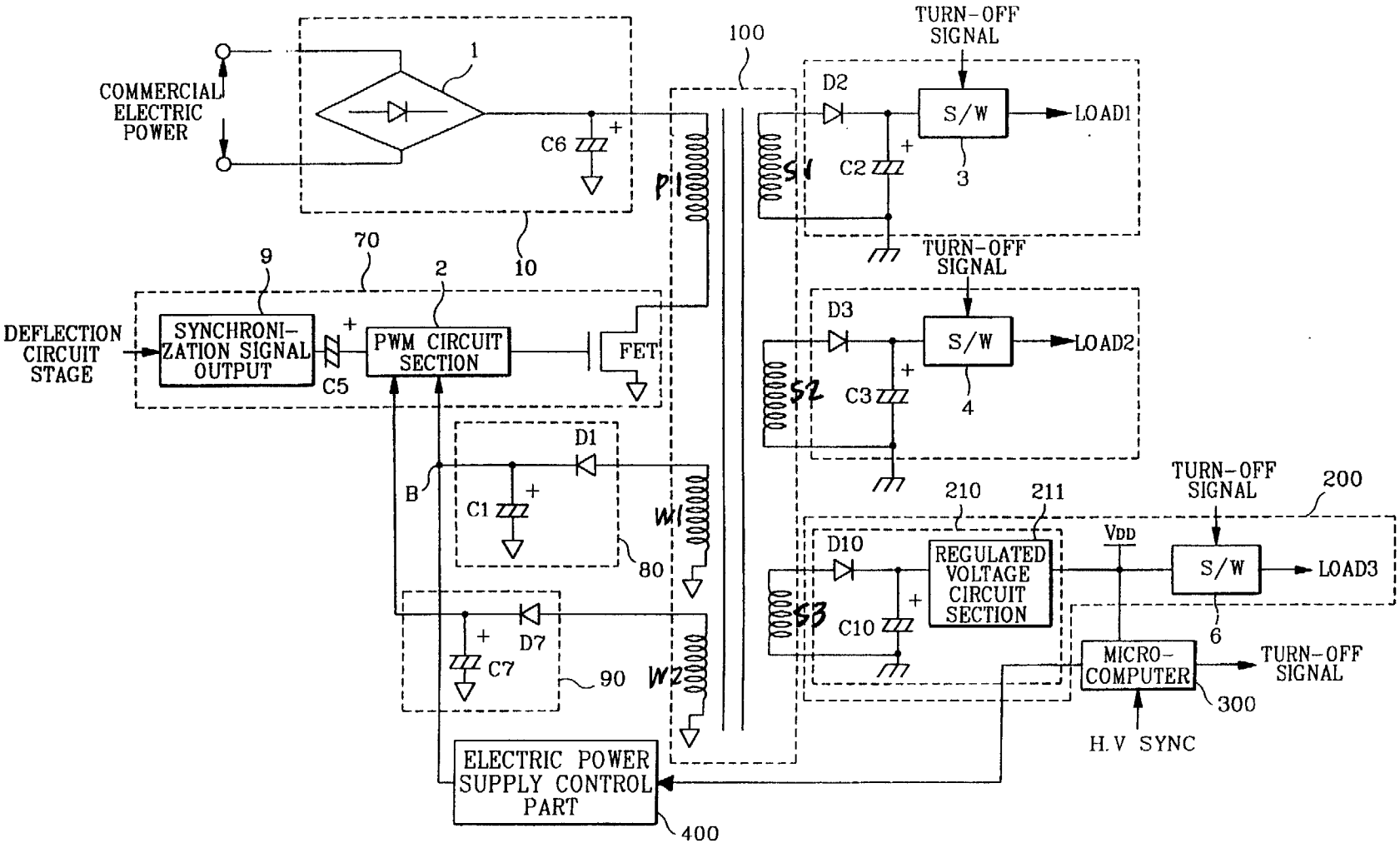
FIG. 5 is a detailed circuit diagram of a second embodiment of the apparatus of FIG. 3.
Figure 6:
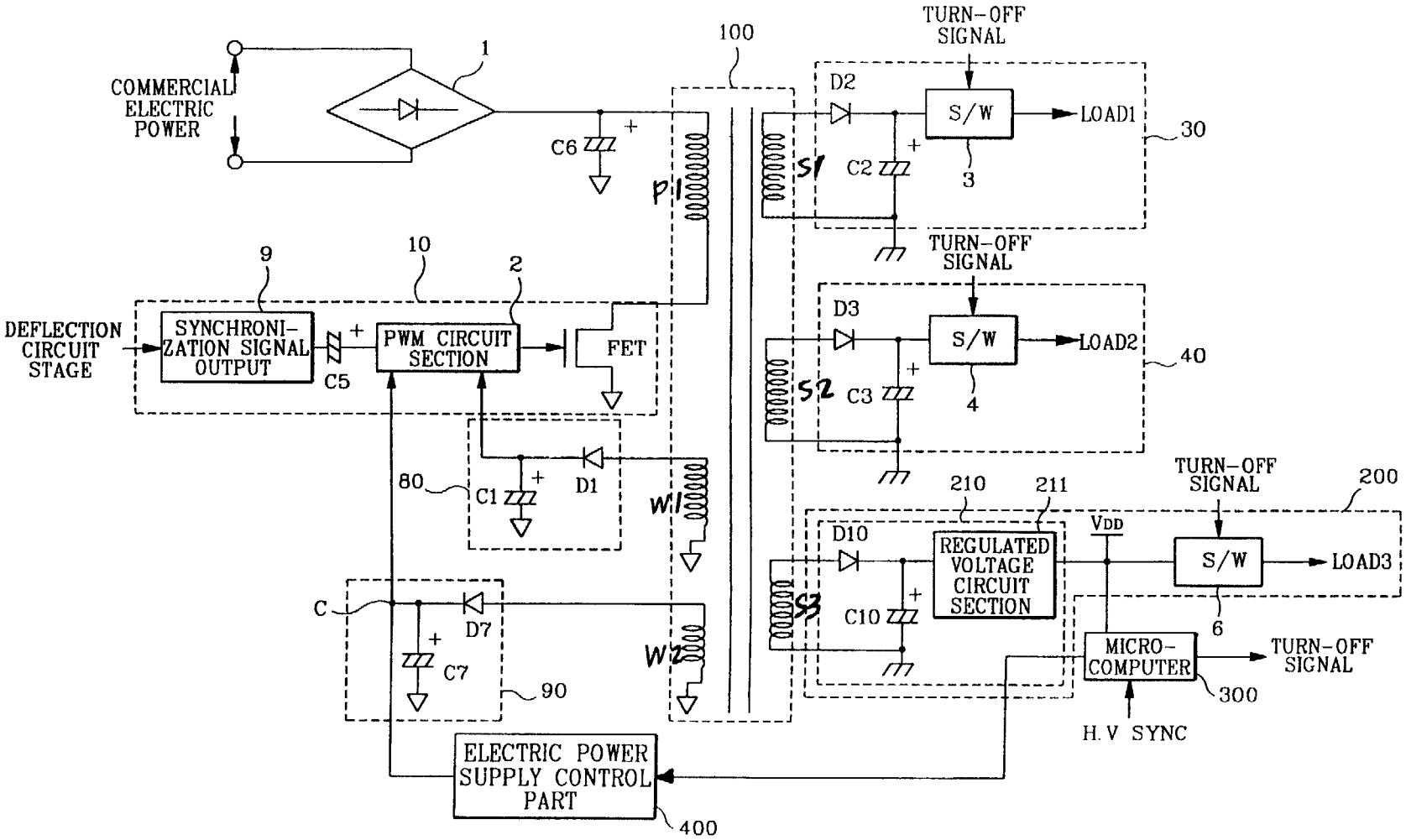
FIG. 6 is a detailed circuit diagram of a third embodiment of the apparatus of FIG. 3.

A description will be provided in detail with respect to the first embodiment of the present invention with reference to FIG. 4 through FIG. 6.

As shown in FIG. 4, which is a circuit diagram of a first embodiment of the apparatus of FIG. 3, the electric power supply control part 400 selectively outputs a PWM pulse of the PWM circuit section 2 in response to an electric power supply control signal inputted from the microcomputer 300.

The operational voltage supply part 210 supplies an operational voltage to the microcomputer 300 while being discharged when a PWM pulse is not generated by a control signal of the electric power supply control part 400. The PWM pulse is generated from the PWM circuit section 2 under the control of the electric power supply control part 400, and energy is induced into a secondary winding when commercial electric power is supplied to the primary winding P1 of the switching transformer 100.

Figure 9:
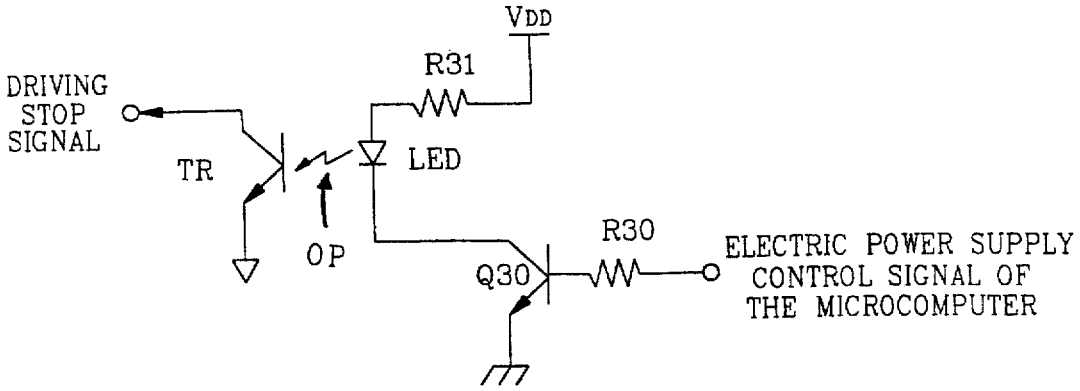
FIG. 9 is a circuit diagram of a first embodiment of the electric power supply control circuit shown in FIG. 3 and FIG. 8.

Referring to FIG. 9, the electric power supply control part 400 includes a switching device Q30 for carrying out a switching operation under the control of an electric power supply control signal outputted from the microcomputer 300 and received via resistor R30, and aphoto-coupler OP for selectively supplying a zero voltage to the PWM circuit section 2 according to a switching operation of the switching device Q30.

Figure 10:
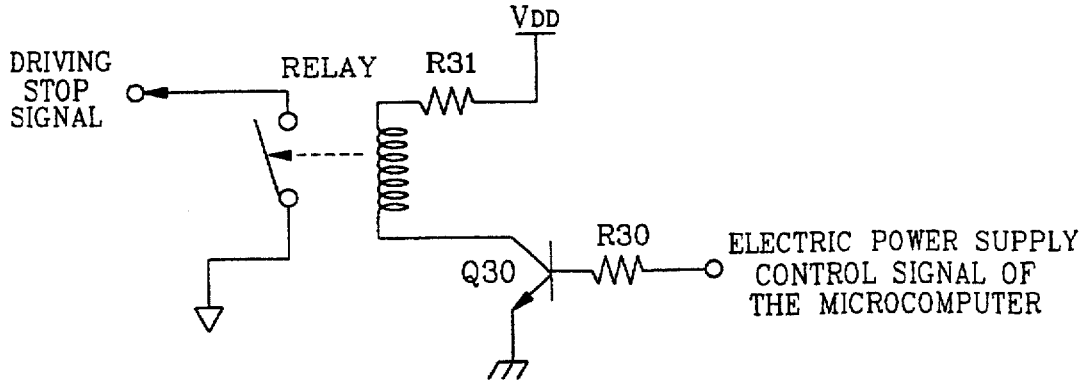
FIG. 10 is a circuit diagram of a second embodiment of the electric power supply control circuit shown in FIG. 3 and FIG. 8.

Referring to FIG.10, the same result may be obtained from the electric power supply control part 400 if the photo-coupler OP of FIG. 9 is replaced with a relay device RELAY.

As shown in FIG. 4, the electric power supply control part 400 is connected to an input side (node A) of the PWM circuit section 2.

The operational voltage supply part 210 includes a fourth output section (D10, C10) having a capacitor C10 of large capacitance for producing a very long discharge time period, and a regulated voltage circuit section 211 for converting a direct voltage supplied from the output section (D10, C10) to an operational voltage.

The microcomputer 300 switches the entire system into an off mode when horizontal and vertical synchronization signals are not inputted from the computer main body, is operated by an operational voltage inputted from the operational voltage supply part 210, and outputs an electric power supply control signal so that a PWM pulse is generated as a remaining voltage falls below a minimum value of an input compensation voltage of the operational voltage supply part 210 when the operational voltage supply part 210 is discharged.

Operation of the electric power-saving apparatus of a display system having the structure as stated above will be described in detail with reference to the accompanying drawings of FIG. 11 and FIG. 12.

Initially, the micro computer 300 determines whether horizontal and vertical synchronization signals inputted from a video card of the computer main body exist (S800). If the horizontal and vertical synchronization signals exist, a normal mode is performed to output a direct voltage to the loads LOAD1, LOAD2, and LOAD3, to thereby carry out a normal operation.

Figure 11:
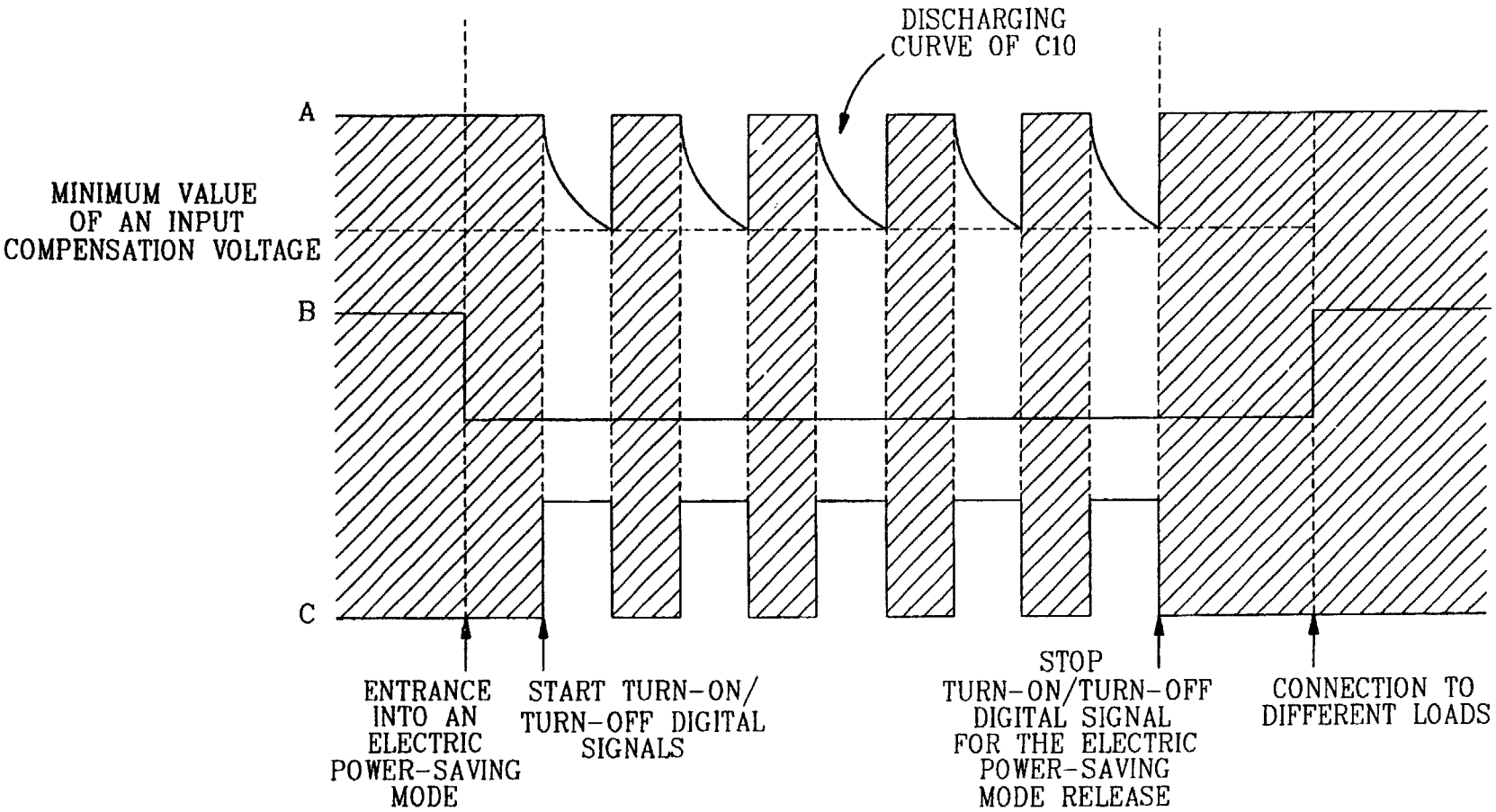
FIG. 11 is a diagram of waveforms generated by the circuit of FIG.4.
Figure 12:
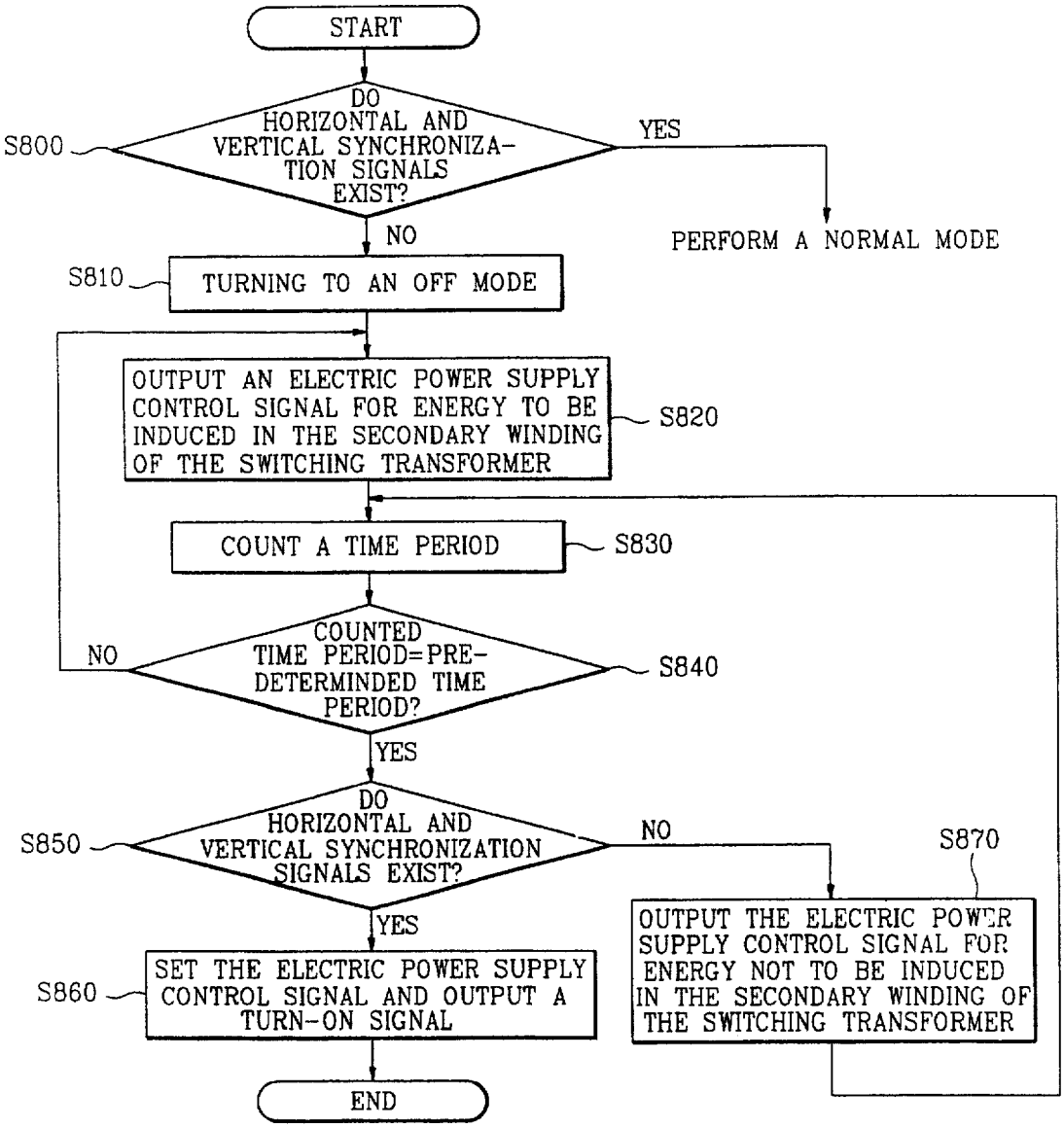
FIG. 12 is a flow chart for describing an electric power-saving method of a display system according to the embodiments of the present invention.

If the horizontal and vertical synchronization signals do not exist, the microcomputer 300, as shown in B of FIG. 11, outputs a turn-off signal to each of the switches 3, 4, and 6 so as to turn the entire system to an off mode, and so that voltage is not outputted to the loads LOAD1, LOAD2, and LOAD3 (S810).

Further, the microcomputer 300, as shown in C of FIG. 11, outputs an electric power supply control signal of a high level to the electric power supply control part 400 after a certain time period elapses (S820). The electric power supply control signal of a high level is inputted to the base of the switching device Q30 through resistor R30 so as to turn on the switching device Q30.

If the switching device Q30 is turned on, the voltage VDD is applied via resistor R31 to the diode LED of the photo-coupler OP, and the diode LED of photo-coupler OP is lit so that a light-receiving transistor TR can detect light for turn-on.

Further, the node A (FIG.4) is pulled down to a zero voltage so as to rapidly discharge the capacitor C5, and so that the zero voltage is supplied to the PWM circuit section 2. Accordingly, the switching device FET is not driven since the PWM pulse is not supplied to the gate of the switching device FET, and thus no energy is induced in the secondary windings S1, S2 and S3 since the primary winding of the switching transformer 100 is not switched.

Therefore, the capacitor C10 of the fourth output section (D10, C10) connected to the microcomputer 300 starts to discharge a voltage as shown in A of FIG. 11. Since the discharged voltage is supplied to the microcomputer 300 through the regulated voltage circuit section 211, the micro-computer 300 carries out a normal operation even if the switching transformer 100 is not switched.

The microcomputer 300 outputs an electric power supply control signal of a low level before the remaining voltage reaches a minimum value of an input compensation voltage of the regulated voltage circuit section 211 from the time when the capacitor C10 starts to be discharged.

When the remaining voltage of the capacitor C10 decreases to a point below a minimum value of the input compensation voltage of the regulated voltage circuit section 211, a voltage outputted to the regulated voltage circuit part 211 is lowered to a point below an operational voltage of the microcomputer 300, so that the microcomputer 300 is not operated.

Therefore, since a signal inputted from the computer main body is not detected, a next operation is not performed, and the system goes down. Accordingly, the main electric power is inputted again to restart the system from the initialization step.

The microcomputer 300 determines a turn-on or a turn-off time of an electric power supply control signal according to a charging/discharging time period of the capacitor C10, as stored in an internal memory of microcomputer 300.

As stated above, after an electric power supply control signal of a high level is outputted (S820), time is counted, and a determination is made as to whether the counted time and a predetermined time in the internal memory match (S840).

When the two times are the same, a determination is made as to whether the horizontal and vertical synchronization signals inputted from a video card of the computer main body exist (S850). When the horizontal and vertical synchronization signals do exist, an electric power supply control signal is set to a turn-off state and then a turn-on signal is outputted to each of the switches 3, 4 and so that voltage is normally supplied to the loads LOAD1, LOAD2 and LOAD3 (S860).

When the horizontal and vertical synchronization signals inputted from the video card of the computer main body do not exist, the microcomputer 300 outputs an electric power supply control signal of a low level (S870).

The electric power supply control signal of a low level is supplied to the base of the switching device Q30 (FIG. 9), the switching device Q30 is turned off, and the photo-coupler OP is also switched into a turn-off state. A voltage of 5V is normally supplied to the node A (FIG. 4) by the capacitor C5, and then the PWM circuit section 2 is normally operated so that a PWM pulse is outputted to the switching device FET.

The switching device FET repeatedly turns on and off in response to the PWM pulse, and a voltage and an electric current are supplied to the primary winding P1 of the switching transformer 100 through the bridge diode 1 and a capacitor C6.

As stated above, if a voltage and an electric current are applied to the primary winding P1, energy is induced in the secondary windings S1, S2 and S3, and then the capacitor C10 of the fourth output part (D10, C10) starts to be charged.

The same operation may be obtained when the photo-coupler OP (FIG. 9) of the electric power supply control part 400 is replaced with a relay RELAY as shown in FIG. 10 in the first embodiment of the present invention. A detailed description the of will be omitted since the operation of the relay RELAY of FIG. 10 is the same as that of the photo-coupler OP of FIG. 9.

FIG. 5 is a circuit diagram of a second embodiment of the apparatus of FIG. 3. Whereas the first embodiment shown in FIG. 4 controls a voltage of the node A so as to thereby control the driving of the PWM circuit section 2, in the embodiment of FIG. 5, an output of the electric power supply control part 400 is applied to a node B to pull down the voltage at node B. Therefore, the capacitor C1 of the feedback circuit part 80 is rapidly discharged, and a feedback pulse monitoring an output of the switching transformer 100 is not inputted to the PWM circuit section 2. Accordingly, the switching of the switching transformer 100 may be controlled. The description of the rest of the operations of the embodiment of FIG. 5 will be omitted since it is the same as in FIG. 4.

FIG. 6 is a circuit diagram of a third embodiment of the apparatus of FIG. 3. The first embodiment shown in FIG. 4 controls the PWM circuit section 2 by controlling a voltage of the node A whereas, in the third embodiment shown in FIG. 6, a node C is connected to an output terminal of the electric power supply control part 400 to control the switching of the switching transformer 100 by controlling electric power inputted to the PWM circuit section 2. The description of the rest of the operations of the embodiment of FIG. 6 is the same as in FIG. 4, and is thus omitted.

Figure 7:
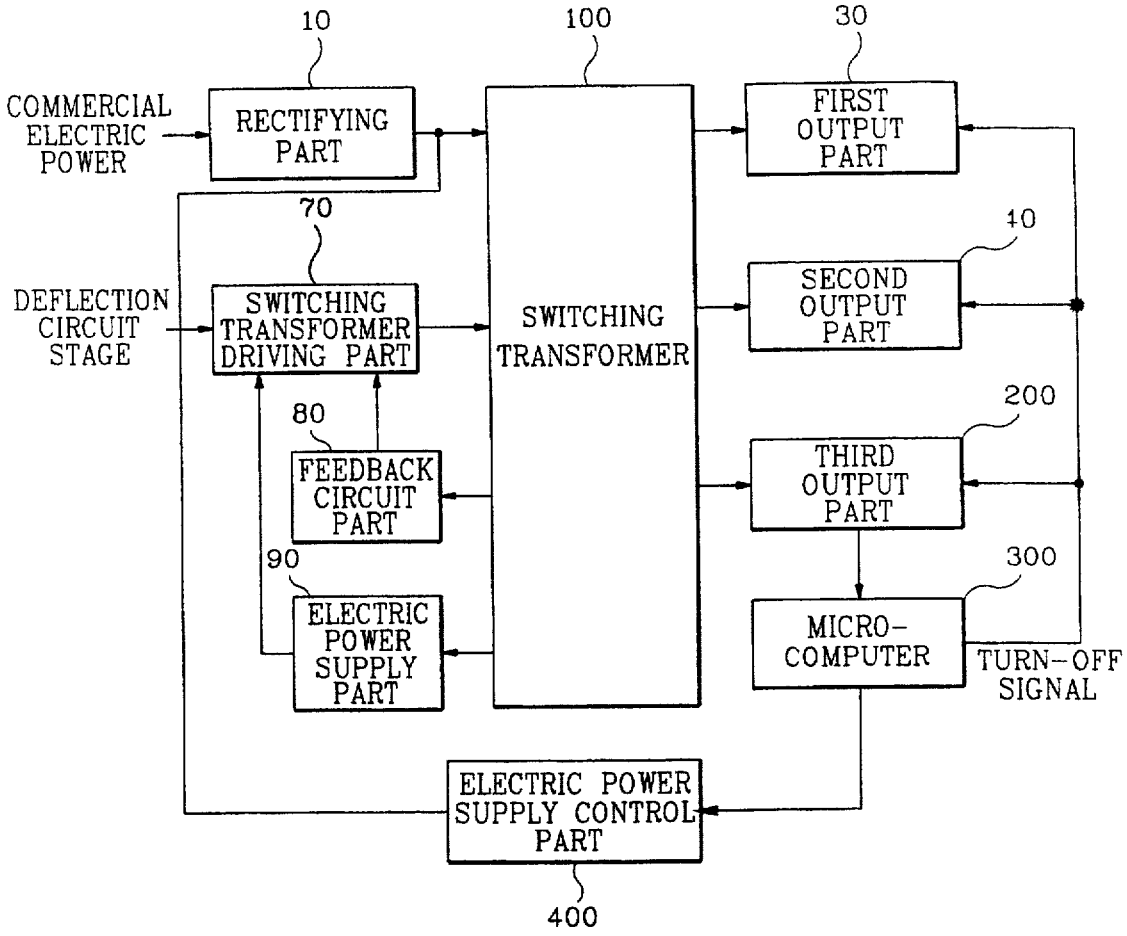
FIG. 7 is a block diagram of an electric power-saving apparatus for a display system according to a second embodiment of the present invention.
Figure 8:
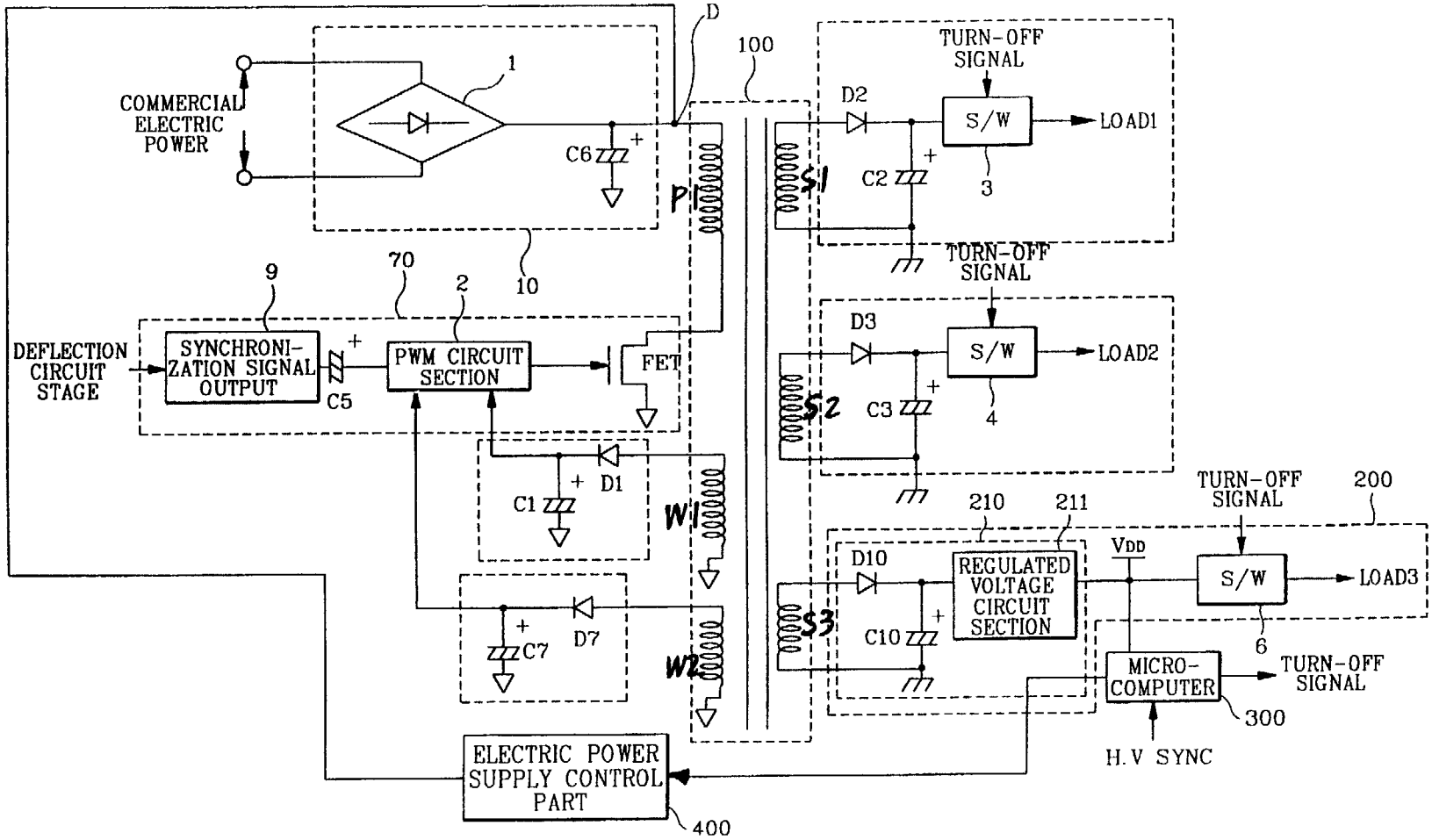
FIG. 8 is a detailed circuit diagram of the apparatus of FIG. 7.

FIG. 7 is a block diagram of an electric power-saving apparatus for a display system according to a second embodiment of the present invention, and FIG. 8 is a detailed circuit diagram of the apparatus of FIG. 7.

As shown in FIG. 7 and FIG. 8, the electric power supply control part 400 selectively supplies commercial electric power to the primary winding P1 of the switching transformer 100 in response to an electric power supply control signal inputted from the microcomputer 300.

The operational voltage supply part 210 is charged with an input of energy induced into the secondary winding S3 in response to a PWM pulse when commercial electric power is supplied to the primary winding of the switching transformer 100 under the control of the electric power supply control part 400, and supplies an operational voltage while discharged when the commercial electric power is not supplied to the primary winding P1 under the control of the electric power supply control part 400.

The microcomputer 400 switches the entire system into an off mode when the horizontal and vertical synchronization signals are not inputted from the computer main body, is enabled based on an operational voltage inputted from the regulated voltage circuit section 211, and outputs an electric power supply control signal in order that a commercial electric power be supplied to the primary winding P1 of the switching transformer 100 as soon as a remaining voltage falls below a minimum value of an input compensation voltage of the regulated voltage circuit section 211 when the regulated voltage circuit section 211 is discharged.

The operation of the second embodiment of an electric power-saving apparatus for a display system having the structure as stated above will be described in detail with reference to FIG. 11 and FIG. 12.

Initially, the microcomputer 300 determines whether the horizontal and vertical synchronization signals inputted from a video card of a computer main body exist (S800). When they do exist, the microcomputer 300 carries out a normal mode, and outputs a direct voltage to the loads LOAD1, LOAD2 and LOAD3 to thereby operate in a normal mode of operation.

When the horizontal and vertical synchronization signals do not exist, the microcomputer 300 outputs a turn-off signal to each of the switches 3, 4 and 6 as shown in B of FIG. 11, and switches the entire system into the off mode in order not to output a voltage to the loads LOAD1, LOAD2, and LOAD3 (S810).

If the microcomputer 300 outputs an electric power supply control signal of a high level to the electric power supply control part 400 after a certain time period elapses, as shown in C of FIG. 11, the electric power supply control signal of a high level is inputted to the base of the switching device Q30 of FIG. 9, and turns on the switching device Q30.

A voltage VDD is inputted to the diode LED of the photo-coupler OP, and the photo-coupler OP is lit so that light-receiving transistor TR is turned on.

Therefore, since the node D (FIG. 8) is pulled down to a zero voltage and the capacitor C6 is rapidly discharged, the zero voltage is supplied to the primary winding P1 of the switching transformer 100, so that no energy is induced in the second windings S1, S2 and S3 of the switching transformer 100.

The capacitor C10 of the fourth output section (D10, C10) connected to the microcomputer 300 starts to be discharged as shown in A of FIG. 11, and the discharged voltage is applied to the microcomputer 300 through the regulated voltage circuit section 211 so that the microcomputer 300 performs in a normal mode of operation even though the switching transformer 100 is not switched.

At this point, the microcomputer 300 outputs an electric power supply control signal of a low level before the capacitor C10 starts to be discharged for its remaining voltage to reach a minimum value of an input compensation voltage of the regulated voltage circuit section 211.

This is due to the fact that, when the remaining voltage of the capacitor C10 becomes lower than the minimum value of the input compensation voltage of the regulated voltage circuit section 211, a voltage outputted to the regulated voltage circuit section 211 becomes lower than an operational voltage of the microcomputer 300 so that the microcomputer 300 is not operated.

Accordingly, since the microcomputer 300 does not detect a signal inputted from the computer main body, the microcomputer 300 does not perform a next operation to cause the system to be shut down, and thus a main electric power is re-inputted to the system in order for the system to be started from the initialization step.

Therefore, the microcomputer 300 determines, and stores in an internal memory, a turn-on time and a turn-off time of an electric power supply control signal according to charging and discharging times of the capacitor C10.

As stated above, the microcomputer 300 outputs an electric power supply control signal of a high level, counts time (S830), and determines whether the count time and the predetermined time in the internal memory are the same (S840).

When the two times are the same, the microcomputer 300 determines whether the horizontal and vertical synchronization signals are inputted from a video card of the computer main body (S850). When the horizontal and vertical synchronization signals exist, the microcomputer 300 sets an output terminal of an electric power supply control signal to a turn-off state, outputs a turn-on signal to each of the switches 3, 4 and 6, and normally supplies a voltage to each of the loads LOAD1, LOAD2, and LOAD3 (S860).

When the horizontal and vertical synchronization signals inputted from a video card of the computer main body do not exist, an electric power supply control signal of a low level is outputted (S870).

The electric power supply control signal of a low level is supplied to the base of the switching device Q30 (FIG. 9), and the switching device Q30 is turned off so that the photo-coupler OP is switched into a turn-off state.

A voltage is normally supplied from the bridge diode 1 (FIG. 8) and the capacitor C6 to a node D, so that a voltage and an electric current are supplied to the primary winding P1 of the switching transformer 100.

As stated above, if a voltage and an electric current are supplied to the primary winding P1 of the switching transformer 100, energy is induced into the secondary windings S1, S2 and S3 of the switching transformer 100, and the capacitor C10 of the fourth output section(D10, C10) is switched into a charging mode.

The second embodiment of the present invention, as stated above, carries out the same operation as in the first embodiment even if the a relay RELAY shown in FIG. 10 is used instead of the photo-coupler OP of FIG. 9 in the electric power supply control part 400. Since the relay RELAY has the same operation as the photo-coupler OP, a detailed description will be omitted.

Accordingly, the present invention as stated above provides an ultra electric power-saving mode for a display system. When the display system is turned into an off mode with no input of the horizontal and vertical synchronization signals from a video card of the computer main body to the display system. It accomplishes this by reducing the total electric power consumption by approximately half, compared to the existing off mode performance, through a remarkable reduction of the on-duty time of a PWM pulse in a range of supplying an operational voltage of the microcomputer with the use of a charging/discharging device of large capacitance.

Although the preferred embodiments of the present invention have been described, it will be understood by those skilled in the art that the present invention should not be limited to the described preferred embodiments, and that various changes may be implemented without departing from the scope of the present invention as defined by the appended claims.

What is claimed is:

1. An electric power-saving apparatus for a display system for providing an electric power-saving mode as an off mode through a reduction of electric power consumed in an entire system when horizontal and vertical synchronization signals are not inputted from a computer main body during a predetermined time period, comprising:

an electric power supply control part for selectively generating a pulse width modulation (PWM) pulse of a PWM circuit section in response to a received electric power supply control signal;

an operational voltage supply part for generating an operational voltage, wherein the operational voltage supply part is charged with energy induced in a secondary winding of a switching transformer when the PWM pulse is generated by the PWM circuit section under control of the electric power supply control part, and wherein commercial electric power is supplied to a primary winding of the switching transformer and the operational voltage supply part is discharged when the PWM pulse is not generated by the PWM circuit section under the control of the electric power supply control part; and a microcomputer driven based on the operational voltage generated by the operational voltage supply part for switching the entire system into the off mode when the horizontal and vertical synchronization signals are not inputted from the computer main body, and for outputting the electric supply control signal to the electric power supply control part as soon as a remaining voltage of the operational voltage supply part becomes lower than a minimum value of an input compensation voltage of the operational voltage supply part when the operational voltage supply part is discharged.

2. The electric power-saving apparatus as claimed in claim 1, wherein the operational voltage supply part comprises:

a regulated voltage circuit section for converting a voltage input to a regulated voltage and supplying the regulated voltage to the microcomputer as the operational voltage for driving the microcomputer; and a charging/discharging device which is charged when energy is induced in the secondary winding of the switching transformer, and which is discharged when energy is not induced in the secondary winding of the switching transformer.

3. The electric power-saving apparatus as claimed in claim 2, wherein the remaining voltage of the operational voltage supply part is are a remaining voltage of the charging/discharging device, and wherein the minimum value of the input compensation voltage of the operational voltage supply part is a minimum value of an input compensation voltage of the regulated voltage circuit section; and wherein a charging start time of the charging/discharging device is a time when the remaining voltage of the charging/discharging device is the same as the minimum value of the input compensation voltage of the regulated voltage circuit section when the charging/discharging device is discharged.

4. The electric power-saving apparatus as claimed in claim 1, wherein the electric power supply control part comprises:

a switching device which is switched based on the electric power supply control signal outputted from the microcomputer; and a photo-coupler for selectively supplying a zero voltage to the PWM circuit section in accordance with a switching operation of the switching device.

5. The electric power-saving apparatus as claimed in claim 1, wherein the electric power supply control part comprises:

a switching device which is switched based on the electric power supply control signal outputted from the microcomputer; and a relay for selectively supplying a zero voltage to the PWM circuit section in accordance with a switching operation of the switching device.

6. The electric power-saving apparatus as claimed in claim 1, wherein the microcomputer sets the entire system to the off mode and sets the electric power supply control signal to a turn-off state before switching the entire system from the off mode to a normal mode when the horizontal and vertical synchronization signals are inputted from the computer main body.

7. An electric power-saving apparatus for a display system for providing an electric power-saving mode as an off mode through a reduction of electric power consumed in an entire system when horizontal and vertical synchronization signals are not inputted from a computer main body during a predetermined time period, comprising:

an electric power supply control part for selectively supplying commercial electric power to a primary winding of a switching transformer in response to a received electric power supply control signal;

an operational voltage supply part which is charged with energy induced in a secondary winding of the switching transformer in response to a pulse width modulation (PWM) pulse when the commercial electric power is supplied to the primary winding of the switching transformer under control of the electric power supply control part, and which is discharged when the commercial electric power is not supplied to the primary winding of the switching transformer under control of the electric power supply control part, said operational voltage supply part providing an operational voltage; and a microcomputer driven based on the operational voltage provided by the operational voltage supply part for switching the entire system into the off mode when the horizontal and vertical synchronization signals are not inputted from the computer main body, and for outputting the electric supply control signal to the electric power supply control part as soon as a remaining voltage of the operational voltage supply part becomes lower than a minimum value of an input compensation voltage of the operational voltage supply part when the operational voltage supply part is discharged.

8. The electric power-saving apparatus as claimed in claim 7, wherein the operational voltage supply part comprises:

a regulated voltage circuit section for converting a voltage inputted to a regulated voltage, and for supplying the regulated voltage to the microcomputer as the operational voltage; and a charging/discharging device which is charged when the energy is induced in the secondary winding of the switching transformer, and which is discharged when energy is not induced in the secondary winding of the switching transformer.

9. The electric power-saving apparatus as claimed in claim 8, wherein the remaining voltage of the operational voltage supply part is are a remaining voltage of the charging/discharging device, and wherein the minimum value of the input compensation voltage of the operational voltage supply part is a minimum value of an input compensation voltage of the regulated voltage circuit section; and wherein a charging start time of the charging/discharging device is a time when the remaining voltage of the charging/discharging device is the same as the minimum value of the input compensation voltage of the regulated voltage circuit section when the charging/discharging device is discharged.

10. The electric power-saving apparatus as claimed in claim 7, wherein the electric power supply control part comprises:

a switching device which is switched based on the electric power supply control signal outputted from the microcomputer; and a photo-coupler for selectively supplying a zero voltage to the primary winding of the switching transformer in accordance with a switching operation of the switching device.

11. The electric power-saving apparatus as claimed in claim 7, wherein the electric power supply control part comprises:

a switching device which is switched based on the electric power supply control signal outputted from the microcomputer; and a relay for selectively supplying a zero voltage to the primary winding of the switching transformer in accordance with the switching operation of the switching device.

12. The electric power-saving apparatus as claimed in claim 7, wherein the microcomputer sets the entire system to the off mode and sets the electric power supply control signal to a turn-off state before switching the entire system from the off mode to a normal mode when the horizontal and vertical synchronization signals are inputted from the computer main body.

13. An electric power-saving method for a display system, comprising the steps of:

(a) determining whether horizontal and vertical synchronization signals are inputted from a computer main body;

(b) performing a normal mode of operation when the horizontal and vertical synchronization signals are inputted from the computer main body; and (c) when the horizontal and vertical synchronization signals are not inputted from the computer main body, performing the following operations:

(c1) turning an entire system into an off mode;

(c2) outputting a turn-off signal to cut off a voltage supplied to at least one load; and (c3) outputting an electric power supply control signal to selectively control an induction of energy in a secondary winding of a switching transformer;

(c4) after outputting the electric power supply control signal, counting a time period;

(c5) determining whether the counted time period is the same as a predetermined time period;

(c6) when the counted time period is the same as the predetermined time period, determining whether the horizontal and vertical synchronization signals are inputted from the computer main body;

(c7) setting the electric power supply control signal to a turn-off state before turning the entire system from the off mode to normal mode and outputting a turn-on signal for supplying the voltage to said at least one load when the counted time period is the same as the predetermined time period, and when the horizontal and vertical synchronization signals are inputted from the computer main body; and (c8) outputting the electric power supply control signal so that the energy is not induced in the secondary winding of the switching transformer when the counted time is the same as the predetermined time period, and when the horizontal and vertical synchronization signals are not inputted from the computer main body.

14. The electric power-saving method as claimed in claim 13, wherein the predetermined time period in the step (c5) is a charging/discharging time period of a charging/discharging device which is charged and discharged by the energy induced in the secondary winding of the switching transformer.

15. The electric power saving method as claimed in claim 13, further comprising the step of:

when the counted time period is not the same as the predetermined time period in step (c5), returning to step (c3).

16. An electric power saving apparatus for a display system having a deflection circuit stage, said apparatus comprising:

a switching transformer having primary and secondary windings;

power input means connected between an external power source and said primary winding for applying electrical current to said primary winding;

switching transformer driving means connected between said deflection circuit stage and said primary winding for selectively switching said primary winding between conducting and non-conducting states so as to selectively induce and not induce energy in said secondary winding;

output means connected to said secondary winding for providing at least one output signal to at least one load in response to the energy induced in said secondary winding; and electric power supply control means connected to one of said power input means and said switching transformer driving means for selectively disabling and enabling operation of said primary winding so as to prevent the energy from being induced in said secondary winding; and microcomputer means responsive to an operational voltage input thereto for monitoring horizontal and vertical synchronization signal inputs from a computer, for providing an off mode control input to said electric power supply control means when horizontal and vertical synchronization signals are not received from said computer so as to cause said electric power supply control means to disable the operation of said primary winding, and for providing an on mode control input to said electric power supply means when the horizontal and vertical synchronization signals are received from said computer supply control means so as to enable the operation of said primary winding.

17. The apparatus of claim 16, wherein said electric power supply control means has an output connected to a junction between said power input means and said primary winding.

18. The apparatus of claim 17, wherein said power input means comprises a bridge diode connected to said external power source and having an output connected in common to both the output of said electric power supply control means and one end of said primary winding.

19. The apparatus of claim 16, wherein said electric power supply control means has an output connected to said switching transformer driving means.

20. The apparatus of claim 19, wherein said switching transformer driving means comprises a synchronization signal output stage connected to said deflection circuit stage, a pulse width modulation (PWM) circuit connected to an output of said synchronization signal output stage and having a PWM output, and a switching device connected between said PWM output and said primary winding.

21. The apparatus of claim 20, wherein said output of said electric power supply control means is connected to a junction between the output of said synchronization signal output stage and an input of said PWM circuit.

22. The apparatus of claim 20, wherein said output of said electric power supply control means is connected to said PWM circuit.

23. The apparatus of claim 22, further comprising a feedback circuit connect ed between an auxiliary winding of said switching transformer and said switching transformer driving means, wherein said output of said electric power supply control means is connected to said PWM circuit through said feedback circuit.

24. The apparatus of claim 22, further comprising an electric power supply part connected between an auxiliary winding of said switching transformer and said switching transformer driving means, wherein said output of said electric power supply control means is connected to said PWM circuit through said electric power supply part.

25. The apparatus of claim 16, further comprising:

operational voltage supply means for generating an operational voltage, wherein the operational voltage supply means is charged with the energy induced in the secondary winding of said switching transformer means when a PWM pulse is generated in said switching transformer driving means, and the operational voltage supply means is discharged when the PWM pulse is not generated in said switching transformer driving means.

26. The apparatus of claim 25, wherein the operational voltage supply means comprises:

a regulated voltage circuit section for converting a voltage input to a regulated voltage and for supplying the regulated voltage to said microcomputer means as the operational voltage; and a charging/discharging device which is charged when the energy is induced in the secondary winding of the switching transformer and discharged when the energy is not induced in the secondary winding of the switching transformer.

27. The apparatus of claim 26, wherein a charging start time of the charging/discharging device is a time when a remaining voltage of the charging/discharging device is the same as a minimum value of an input compensation voltage of the regulated voltage circuit section when the charging/discharging device is discharged.

28. The apparatus of claim 16, wherein said electric power supply control means comprises:

a switching device which is switched based on an electric power supply control signal outputted from said microcomputer means; and a photo-coupler for selectively supplying a zero voltage to said switching transformer driving means in accordance with a switching operation of the switching device.

29. The apparatus of claim 16, wherein said electric power supply control means comprises:

a switching device which is switched based on an electric power supply control signal outputted from said microcomputer means; and a relay for selectively supplying a zero voltage to said switching transformer driving means in accordance with a switching operation of the switching device.

30. The apparatus of claim 16, wherein said microcomputer means sets the system to an off mode and sets an electric power supply control signal from said electrical power supply control means to a turn-off state before turning the system from the off mode to a normal mode when the horizontal and vertical synchronization signals are not received from the computer.

* * * * *